US006502921B2

(12) United States Patent
Kanda et al.

(10) Patent No.: US 6,502,921 B2
(45) Date of Patent: Jan. 7, 2003

(54) INK JET HEAD HAVING A PLURALITY OF UNITS AND ITS MANUFACTURING METHOD

(75) Inventors: Torahiko Kanda, Tokyo (JP); Kenichi Ohno, Tokyo (JP); Yasuhiro Otsuka, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/778,443

(22) Filed: Feb. 7, 2001

(65) Prior Publication Data

US 2001/0024217 A1 Sep. 27, 2001

(30) Foreign Application Priority Data

Mar. 21, 2000 (JP) ..... 2000-078898

(51) Int. Cl.[7] ..... B41J 2/15
(52) U.S. Cl. ..... 347/40; 347/42; 347/70
(58) Field of Search ..... 347/42, 12, 40, 347/13, 70, 49, 59

(56) References Cited

U.S. PATENT DOCUMENTS

| | | | | |
|---|---|---|---|---|
| 5,160,403 | A | 11/1992 | Fisher et al. | 438/21 |
| 5,469,199 | A | 11/1995 | Allen et al. | 347/42 |
| 5,521,125 | A | 5/1996 | Ormond et al. | 347/20 |
| 5,572,244 | A | 11/1996 | Drake et al. | 347/42 |
| 5,719,605 | A | 2/1998 | Anderson et al. | 347/59 |
| 5,723,053 | A | 3/1998 | Momose et al. | 216/27 |
| 5,850,240 | A | 12/1998 | Kubatzki | 347/49 |

FOREIGN PATENT DOCUMENTS

| | | |
|---|---|---|
| DE | 42 01 923 A1 | 8/1992 |
| DE | 197 43 804 A1 | 4/1999 |
| EP | 0 339 912 A2 | 11/1989 |
| EP | 0 370 776 A2 | 5/1990 |
| EP | 0 666 174 A2 | 8/1995 |
| EP | 0 771 657 A2 | 5/1997 |
| JP | 6-218932 | 8/1994 |

*Primary Examiner*—Lamson Nguyen
(74) *Attorney, Agent, or Firm*—Choate, Hall & Stewart

(57) ABSTRACT

An ink jet head is constructed by a plurality of combined units, wherein each of said units comprises a plurality of abutting portions and at least one recessed portion shaped to engage at least one of the abutting portions formed on another unit, and wherein at least a first of the units includes a first protruded abutting portion and at least a second one of the units includes a second protruded abutting portion, said first and second protruded portions abutting against each other.

28 Claims, 11 Drawing Sheets

INK JET HEAD HAVING A PLURALITY OF UNITS AND ITS MANUFACTURING METHOD

BACKGROUND OF THE INVENTION

1. Field of the Invention

The present invention relates to an ink jet head and its manufacturing method.

2. Description of the Related Art

A prior art ink jet head is constructed by a single unit including laminated substrates such as a monocrystalline silicon substrate and a glass substrate (see JP-A-6-218932). This will be explained later in detail.

In the above-mentioned prior art ink jet head, however, when the density of nozzles is increased to improve the printing quality while the printing speed is being increased, even if one nozzle is defective in one unit, such a unit has to be scrapped, so that the manufacturing yield of the units is decreased, thus increasing the manufacturing cost of the ink jet head.

SUMMARY OF THE INVENTION

It is an object of the present invention to provide an ink jet head and its manufacturing method capable of decreasing the manufacturing cost.

According to the present invention, an ink jet head is constructed by a plurality of combined units.

Also, in a method for manufacturing an ink jet head, a plurality of units are formed in a substrate. Then, the units are separated from each other. Finally, one ink jet head is formed by combining at least two of the units.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENT

Before the description of the preferred embodiment, a prior art ink jet head will be explained with reference to FIGS. 1, 2 and 3.

Figure 1:
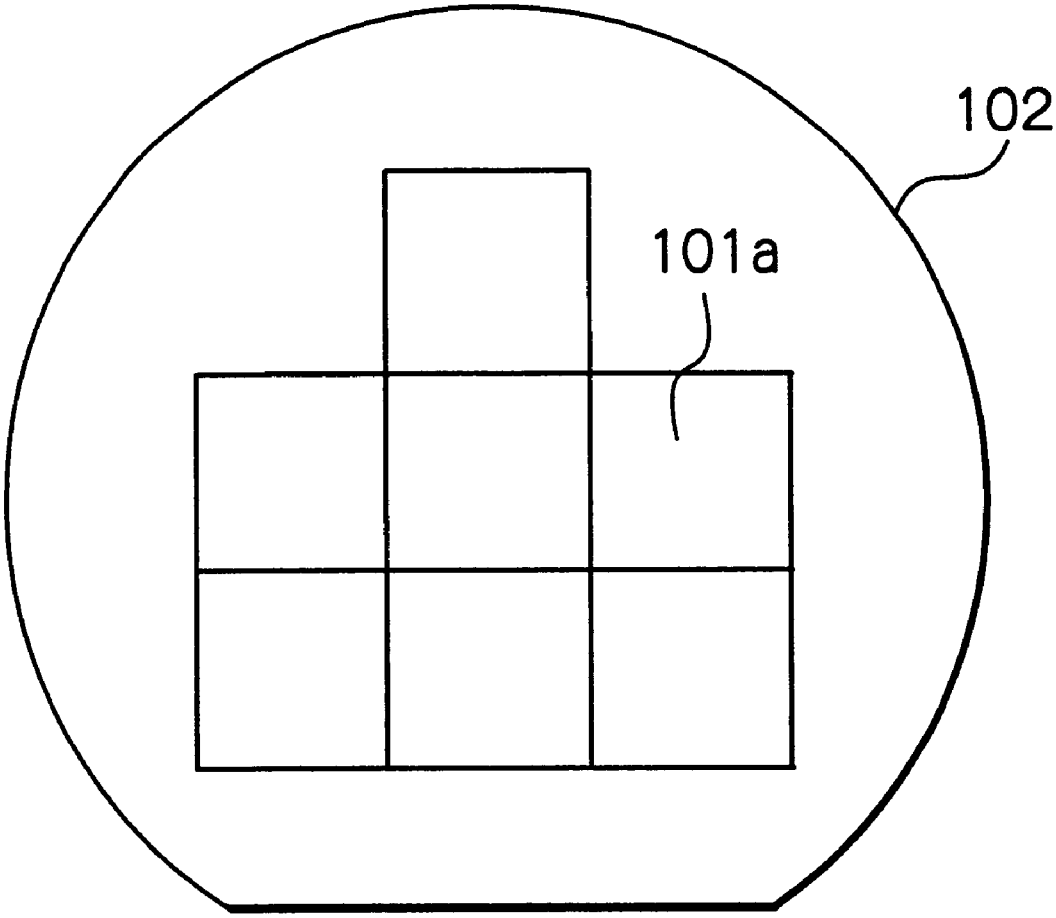
Fig. 1 PRIOR ART
FIG. 1 is a plan view illustrating a semiconductor wafer where prior art ink jet units are formed.

A prior art ink jet head is formed by a single unit 101*a* as illustrated in FIG. 1 including laminated substrates such as a monocrystalling silicon substrate and a glass substrate (see JP-A-6-218932). For example, if each unit 101*a* has a size of about 27 mm×27 mm, seven units 101*a* are cut by a dicing blade (not shown) from an about 10-cm diameter monocrystalline silicon wafer 102 as illustrated in FIG. 1.

Figure 2:
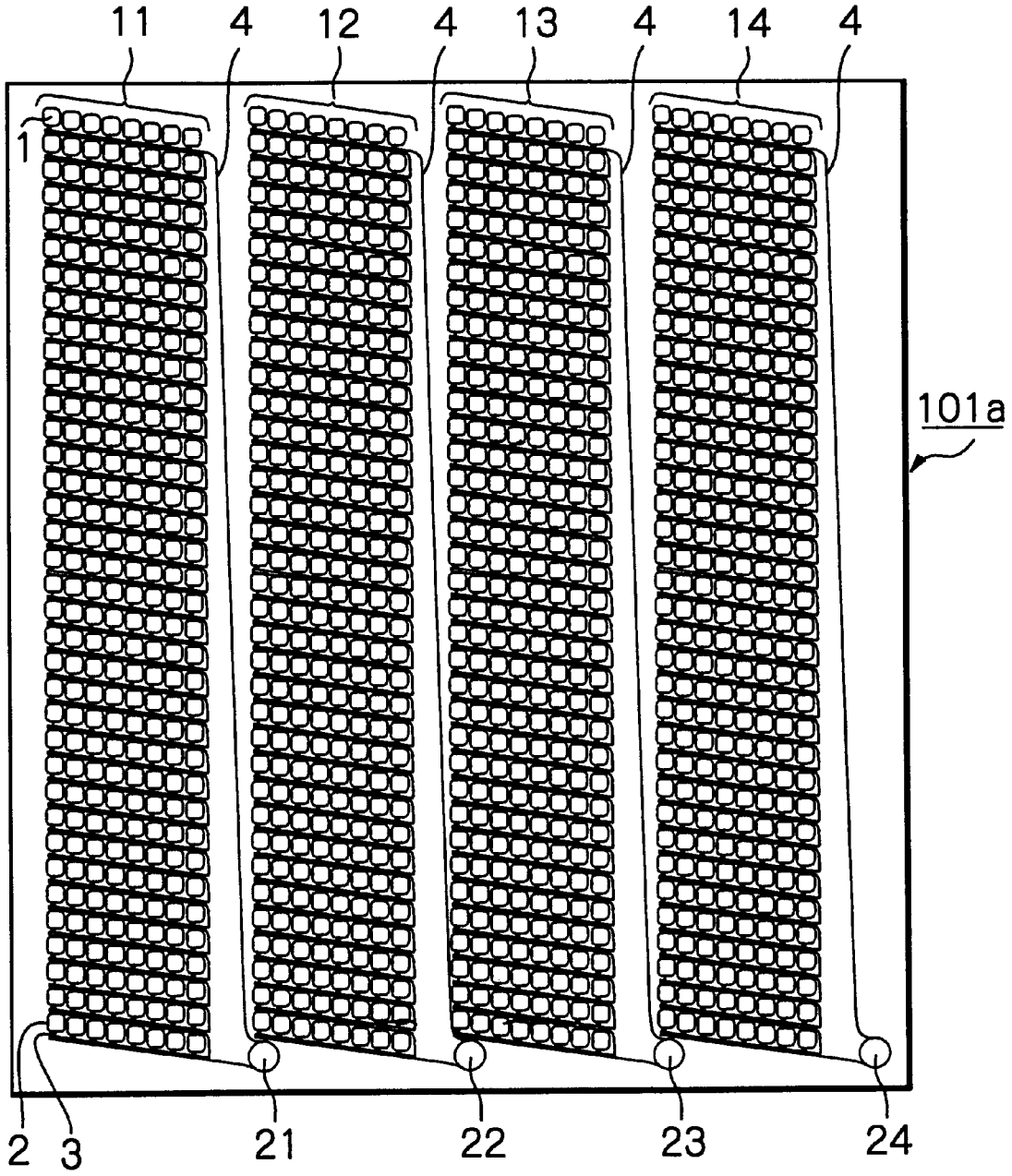
Fig. 2 PRIOR ART
FIG. 2 is a plan view of one of the ink jet units of FIG. 1.

In FIG. 2, which is a detailed plan view of each of the units 101*a* of FIG. 1, four nozzle columns 11, 12, 13 and 14 where nozzles 1 are closely arranged in a matrix are provided. In this case, the nozzle columns 11, 12, 13 and 14 are used for ejecting black ink, yellow ink, cyan ink and magenta ink, respectively. The nozzle columns 11, 12, 13 and 14 are connected to ink supply holes 21, 22, 23 and 24, respectively.

Figure 3:
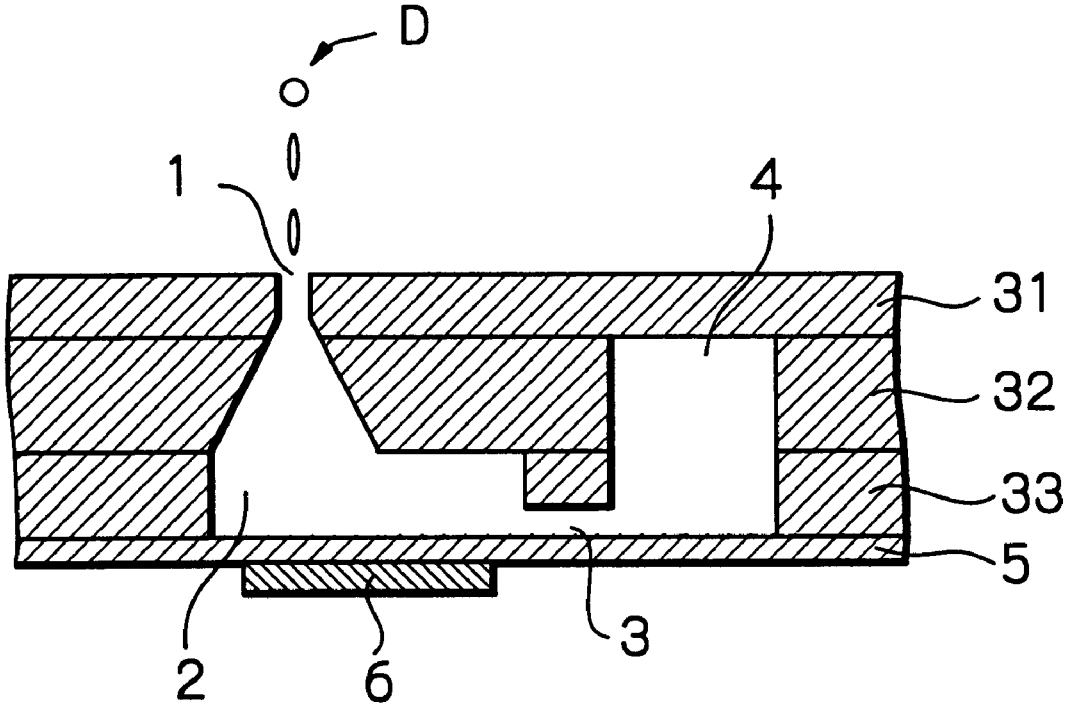
Fig. 3 PRIOR ART
FIG. 3 is a cross-sectional view of the periphery of one nozzle of FIG. 2.

As illustrated in FIG. 3, which is a cross-sectional view of the periphery of one nozzle 1 of FIG. 2, one pressure chamber 2 linked to the nozzle 1, an ink passage 3 and an ink pool (reservoir) 4 are partitioned by a plurality of substrates 31, 32 and 33 made of monocrystalline silicon and glass, and a thin vibration plate 5 on which an actuator 6 made of piezoelectric material sandwiched by metal electrodes is formed. Note that the ink pool 4 for each of the nozzle columns 11, 12, 13 and 14 is comb-shaped as illustrated in FIG. 2.

Also, in FIG. 3, reference D designates an ink droplet.

In the ink jet head formed by a single unit 101*a*, however, when the density of nozzles is increased to improve the printing quality while the printing speed is being increased, even if one nozzle is clogged or deformed, i.e., defective in one unit 101*a*, such a unit has to be scrapped, so that the manufacturing yield of the units 101*a* is decreased, thus increasing the manufacturing cost of the ink jet head.

For example, if the nozzle 1 has a diameter of about 25 to 40 $\mu$m, the average number of defective nozzles 1 is expected to be 4 in one monocrystalline silicon wafer 102. In this case, four units 101*a* may be defective, so that the manufacturing yield of the units 101*a* in one monocrystalline silicon wafer 102 may be 3/7 (=43 percent).

Figure 4:
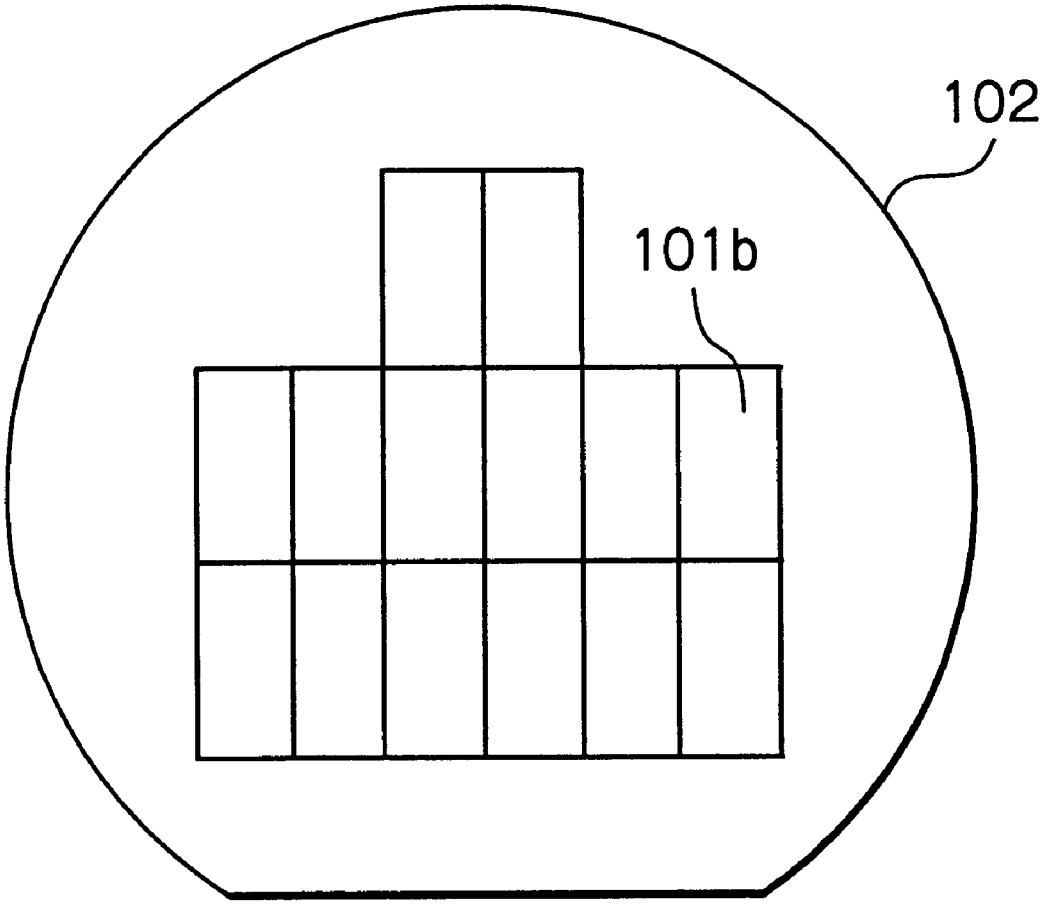
FIG. 4 is a plan view illustrating a semiconductor wafer where ink jet units according to the present invention are formed.

An embodiment of the ink jet head according to the present invention is formed by a plurality of units 101*b*, for example, two units 101*b* as illustrated in FIG. 4 including a monocrystalline silicon substrate. For example, if each unit 101*b* has a size of about 27 mm×13 mm, fourteen units 101*b* are cut by a dicing blade from an about 10-cm diameter monocrystalline silicon wafer 102.

Figure 5:
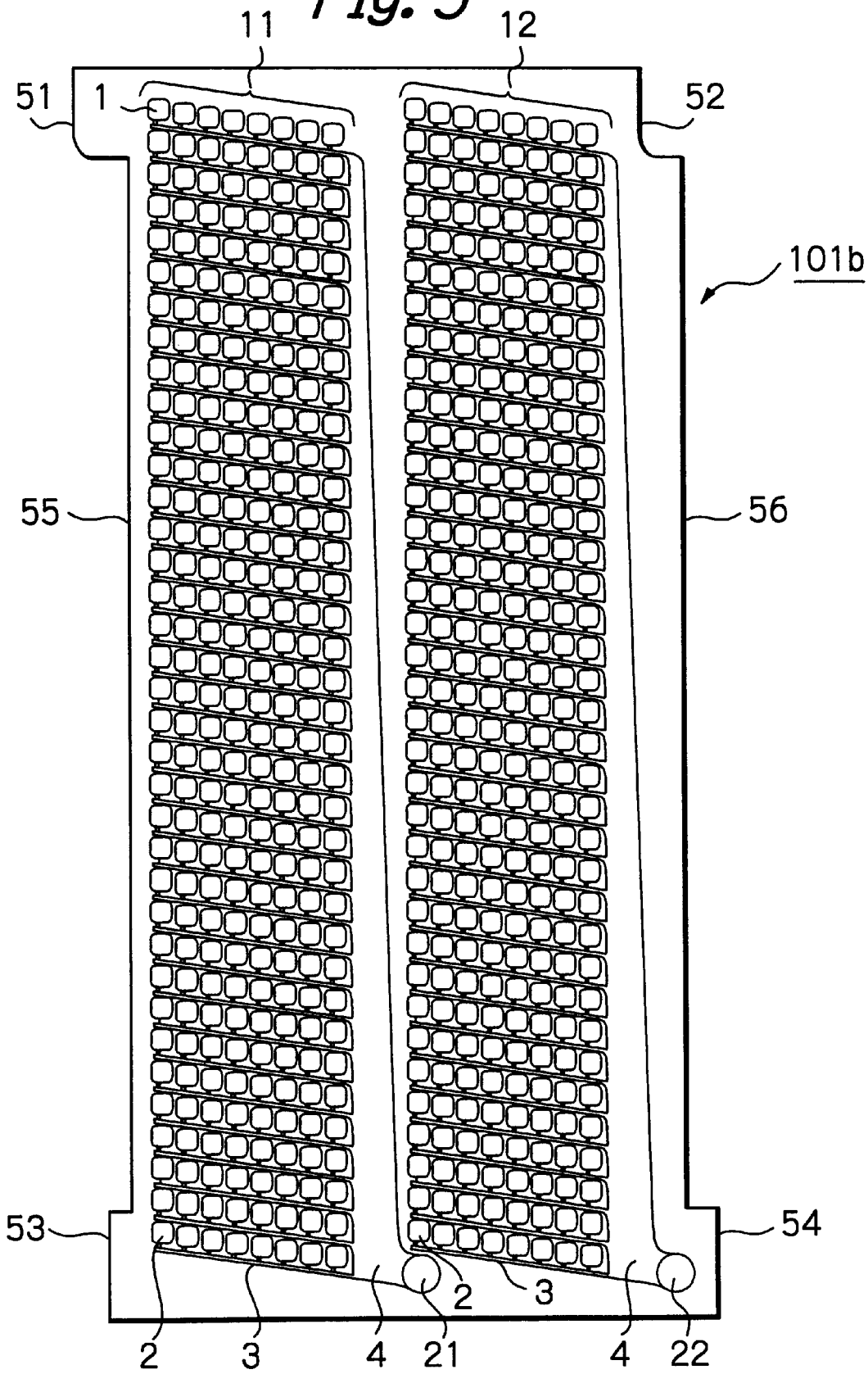
FIG. 5 is a plan view of one of the ink jet units of FIG. 4.

In FIG. 5, which is a detailed plan view of each of the units 101*b* of FIG. 4, two nozzle columns 11 and 12 where nozzles 1 are closely arranged in a matrix are provided. In this case, the nozzle columns 11 and 12 are used for ejecting black ink (or cyan ink) and yellow ink (or magenta ink), respectively. The nozzle columns 11 and 12 are connected to ink supply holes 21 and 22, respectively.

As illustrated in FIG. 5, in each of the units 102*b*, a protruded abutting portion 51, a recessed abutting portion 52, a protruded abutting portion 53 and a protruded abutting portion 54 are formed. As a result, a relief (recess) 55 is formed between the protruded abutting portions 51 and 53, and a relief (recess) 56 is formed between the abutting portions 52 and 54. Note that the protruded abutting portion 51 has the same shape as the recessed abutting portion 52.

In the ink jet head formed by two of the units 101*b*, if the nozzle 9 has a diameter of about 25 to 40 $\mu$m, the average number of defective nozzles 1 is also expected to be 4 among one monocrystalline silicon wafer 102. In this case, four units 101*b* may be defective, so that the manufacturing yield of the units 101*b* among one monocrystalline silicon wafer 102 may be 3/14 (=22 percent). Thus, the manufacturing yield can be remarkably increased as compared with the prior art units 101*a*.

Figure 6:
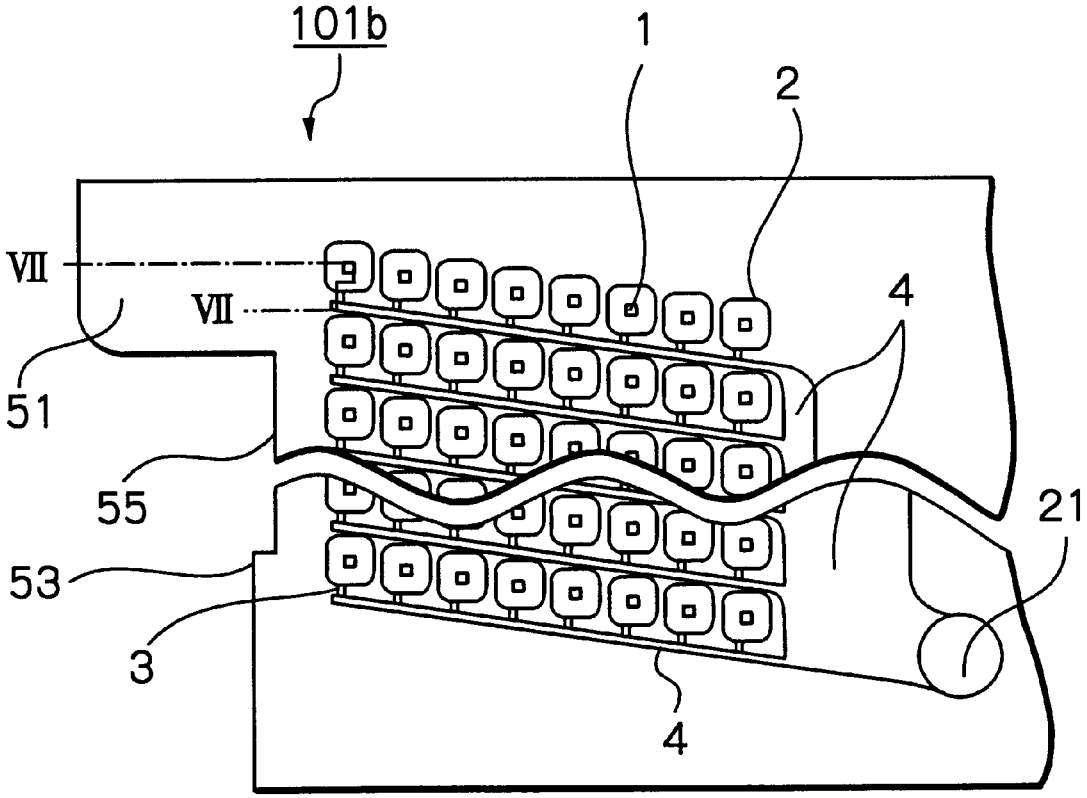
FIG. 6 is a partially-enlarged view of the unit of FIG. 5.
Figure 8A:
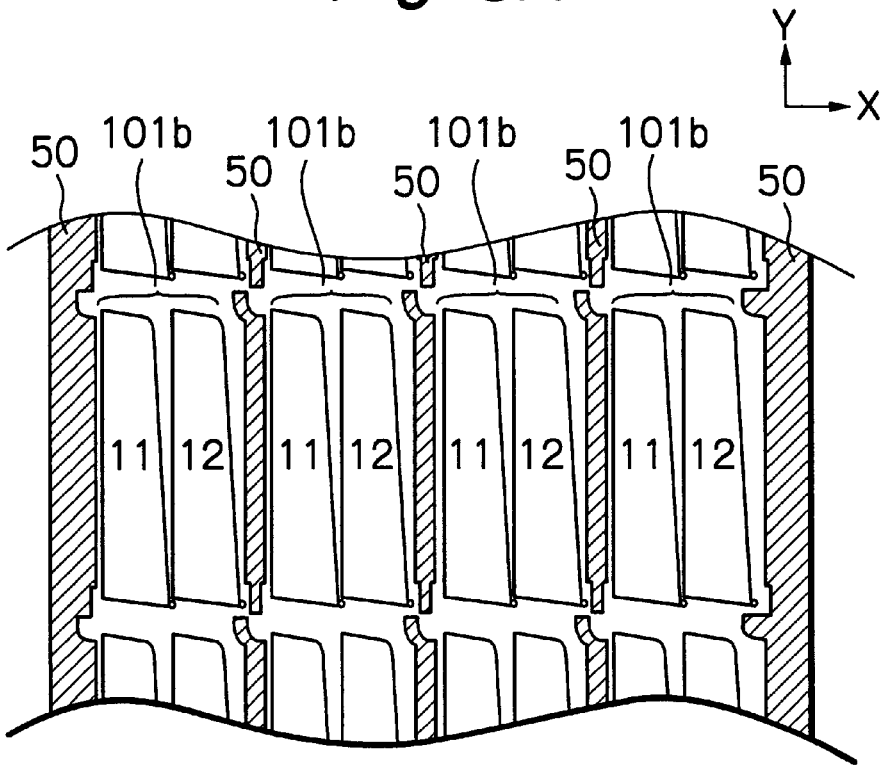
FIGS. 8A and 8B are plan views of the semiconductor wafer of FIG. 4 before and after the separation of units, respectively.
Figure 8B:
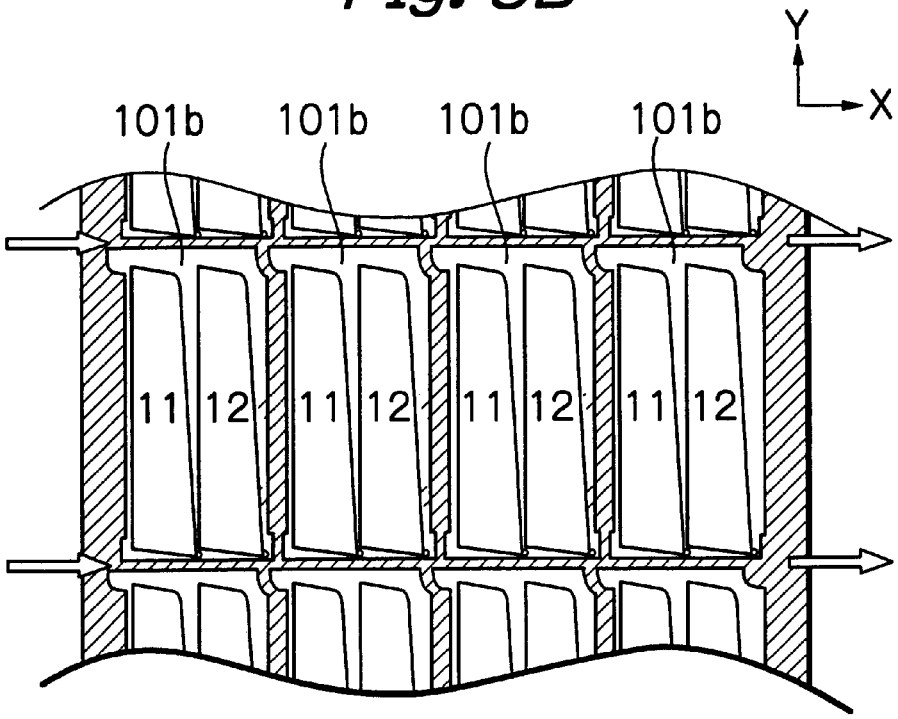
Figure 9:
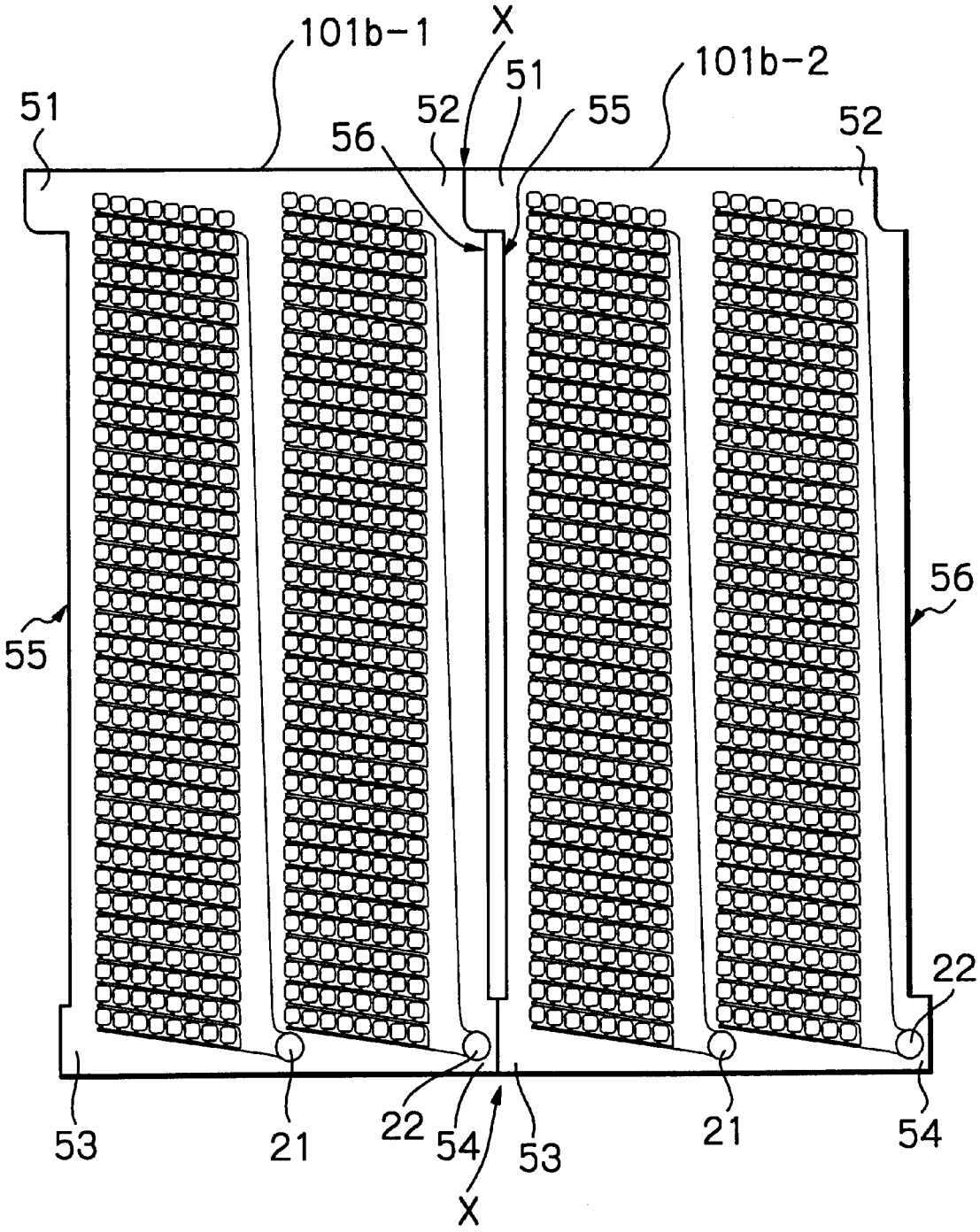
FIG. 9 is a plan view for explaining the combination of two non-defective units of FIGS. 8A and 8B.
Figure 10:
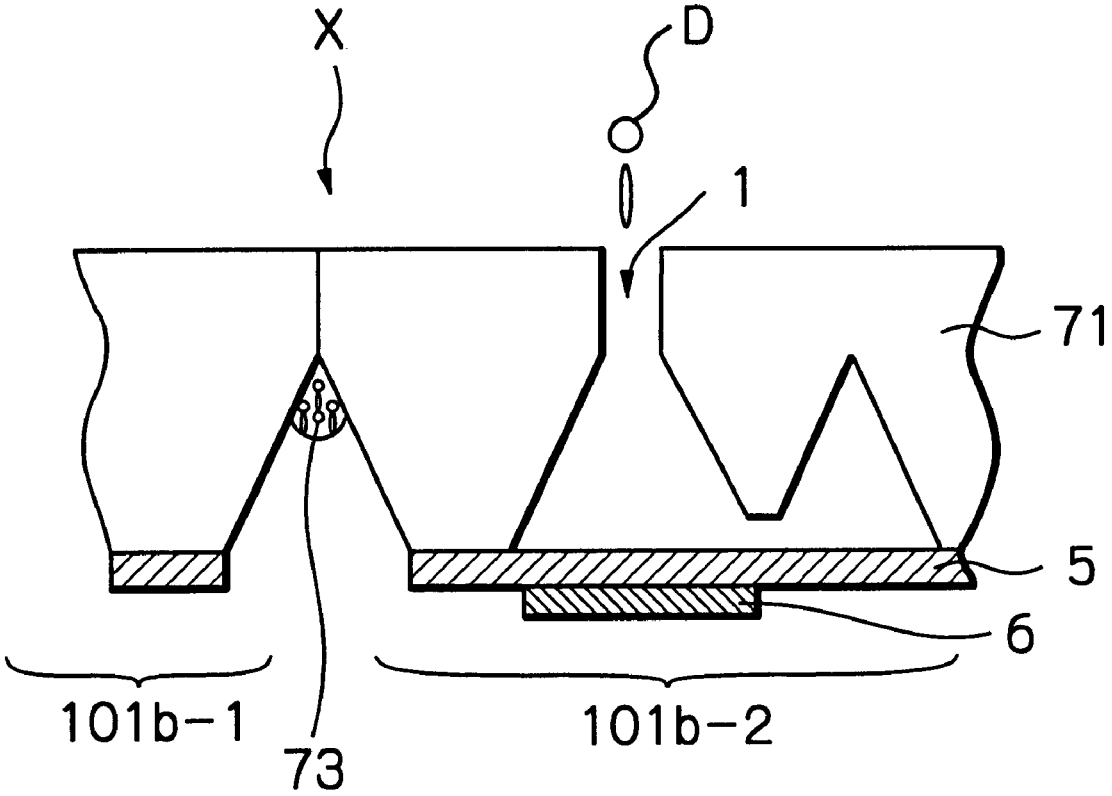
FIG. 10 is a cross-sectional view of the abutting portion of the non-defective units of FIG. 9.

A method for manufacturing an ink jet head according to the present invention is explained next with reference to FIGS. 6, 7A, 7B, 7C, 7D, 8A, 8B, 9 and 10. Note that FIG. 6 is a partially-enlarged view of the unit 101*b* of FIG. 5, and FIGS. 7A, 7B, 7C and 7D are cross-sectional views taken along the line VII—VII of FIG. 6. Also, FIGS. 8A and 8B are plan views of the semiconductor wafer of FIG. 4 before and after the separation of units respectively. Further, FIG. 9 is a plan view for explaining the combination of two non-defective units of FIGS. 8A and 8B, and FIG. 10 is a cross-sectional view of the abutting portion of the non-defective units of FIG. 9.

Figure 7A:
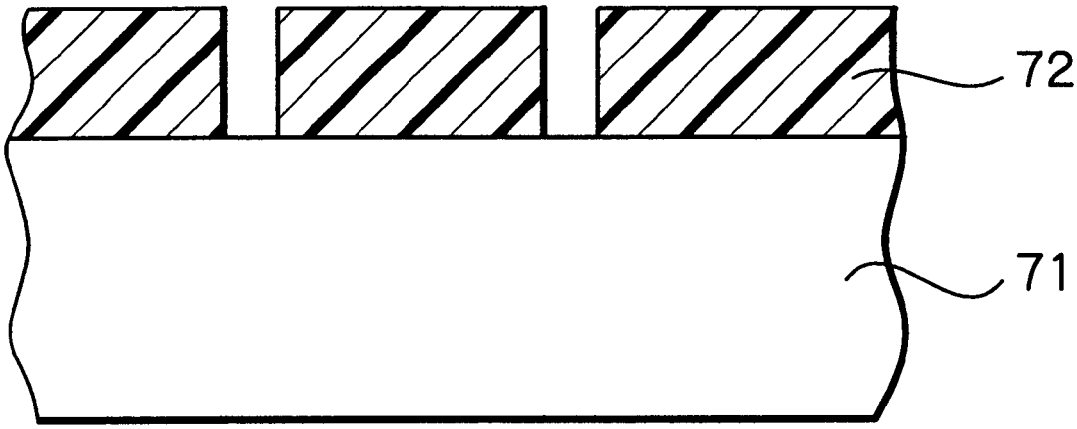
FIGS. 7A, 7B, 7C and 7D are cross-sectional views taken along the line VII—VII of FIG. 6.

First, referring to FIG. 7A as well as FIG. 6, a photoresist pattern 72 is formed by a photolithography process on a front surface of a monocrystalline silicon substrate 71.

Figure 7B:
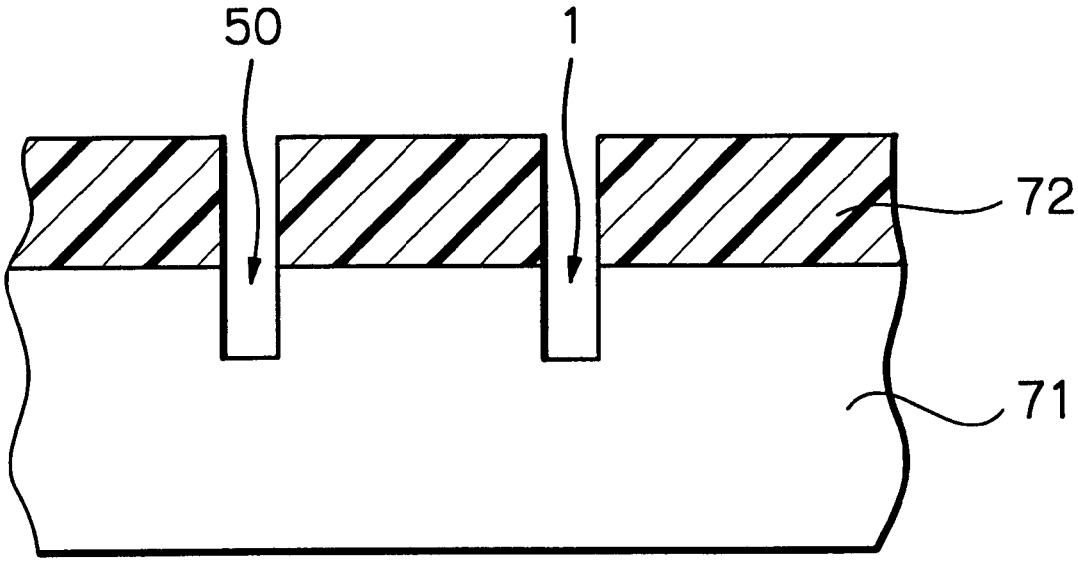

Next, referring to FIG. 7B as well as FIG. 6, the monocrystalline silicon substrate 71 is etched by a reactive ion etching (RIE) dry process using the photoresist pattern 72 as a mask. As a result, a nozzle 1 is perforated in the monocrystalline silicon substrate 71, and simultaneously, an edge 50 for the abutting portions 51, 52, 53 and 54 and the reliefs 55 and 56 is perforated. Then, the photoresist pattern layer 72 is removed.

Figure 7C:
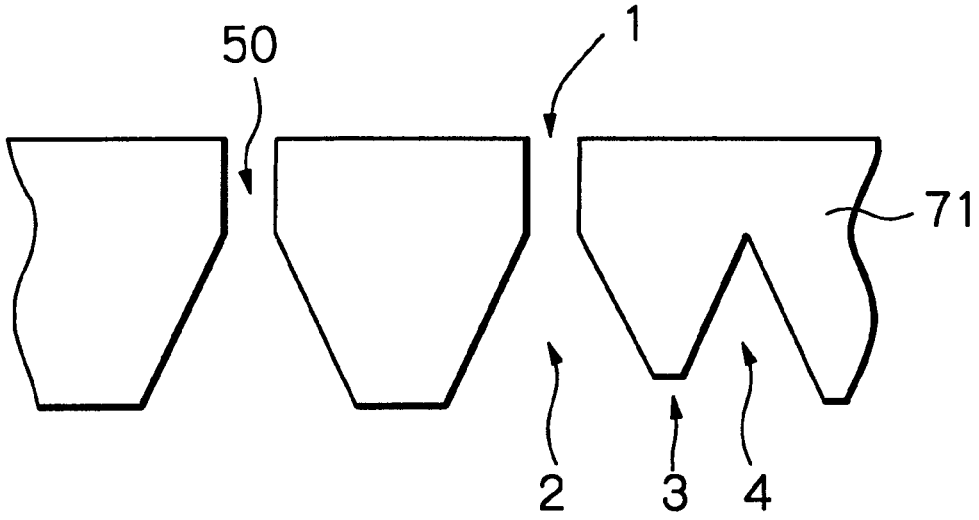

Next, referring to FIG. 7C as well as FIG. 6, a photoresist pattern layer (not shown) is formed by a photolithography process on a back surface of the monocrystalline silicon substrate 71. Then, the monocrystalline silicon substrate 71 is etched by an anisotropic wet etching process using the photoresist pattern layer as a mask. As a result, a pressure chamber 2, an ink passage 3 and an ink pool (reservoir) 4 are perforated in the monocrystalline silicon substrate 71, and simultaneously the edge 50 for the abutting portions 51, 52, 53 and 54 and the reliefs 55 and 56 is completely perforated through the monocrystalline silicon substrate 71. Then, the photoresist pattern layer is removed.

In this state, it is determined whether a clogging state (deformed state) is observed in the nozzle 1, the pressure chamber 3, the ink passage 3 and the ink pool (reservoir) 4.

Figure 7D:
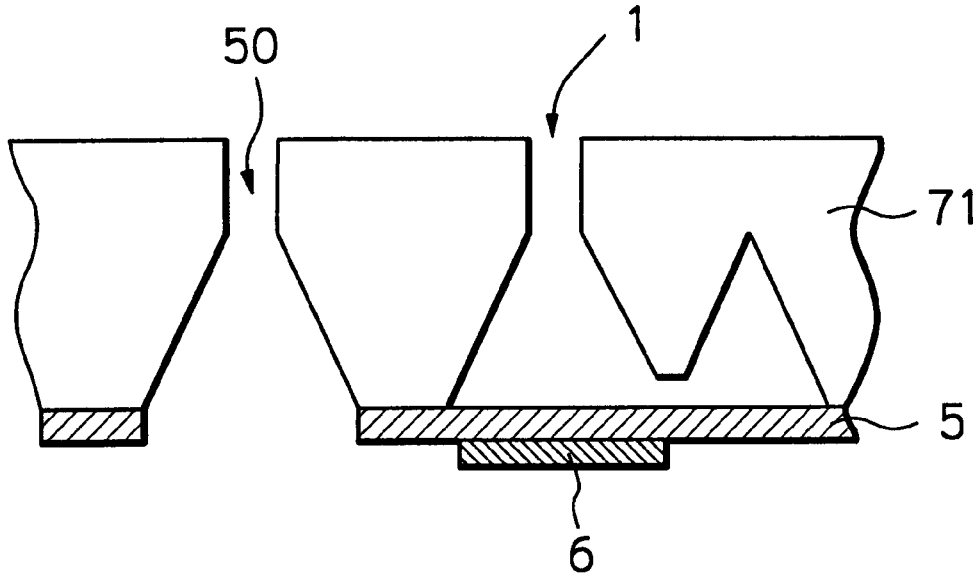

Next, referring to FIG. 7D as well as FIG. 6, a wafer-type thin vibration plate 5, which is perforated in advance to be adapted to the edge 50, is adhered by a contact bonding process to the back surface of the monocrystalline silicon substrate 71. Then, one actuator 6 made of piezoelectric material sandwiched by metal electrodes is adhered by a contact bonding process to the thin vibration plate 5 in correspondence with each nozzle 1.

In FIG. 7D, note that it is possible to adhere actuators 6 to a wafer-type thin vibration plate 5 before the wafer-type thin vibration plate 5 is adhered to the back surface of the monocrystalline silicon substrate 71.

Next, the separation of the units 101*b* is explained with reference to FIGS. 8A and 8B.

After the process as illustrated in FIG. 7D, the monocrystalline silicon substrate 71 is divided by the edge 50 along the Y-direction into columns of the units 101*b*, as illustrated in FIG. 8A.

Next, as illustrated in FIG. 8B, the monocrystalline silicon substrate 71 is cut by a dicing blade (not shown) along the X-direction. As a result, each of the units 101*b* is completely separated from each other.

In this state, it is again determined whether a clogging state (deformed state) is observed in each of the units 101*b*. Then, defective units 101*b* having a clogging state (deformed state) are scrapped.

Next, referring to FIG. 9, an ink jet head is constructed by combining two non-defective units 101*b*-1 and 101*b*-2. That is, the recessed abutting portion 52 of the non-defective unit 101*b*-1 abuts against the protruded abutting portion 51 of the non-defective unit 101*b*-2, while the protruded abutting portion 54 of the non-defective unit 101*b*-1 abuts against the protruded abutting portion 53 of the non-defective unit 101*b*-2. In this case, the contact characteristics between the non-defective units 101*b*-1 and 101*b*-2 can be improved due to the presence of the reliefs 55 and 56 thereof. Then, the abutting portions of the nondefective units 101*b*-1 and 101*b*-2 indicated by arrows X in FIG. 9 are filled with adhesives 73, as illustrated in FIG. 10.

Finally, electrical connections are formed on the back surface of the combined units 101*b*-1 and 101*b*-2, and the ink supply holes 21 and 22 thereof are coupled to individual ink tanks for black ink, yellow ink, cyan ink and magenta ink, respectively.

The combination of the units 101*b*-1 and 101*b*-2 can be carried out without an expensive alignment apparatus, which would decrease the manufacturing cost.

Also, since the abutting portions 51, 52, 53 and 54 are formed by a photolithography and etching process, not a dicing blade, the accuracy of the distance between the edge 50 of the abutting portions 51, 52, 53 and 54 and the nozzles 1 of each of the combined units 101*b*-1 and 101*b*-2 can be high, i.e., about ±1 μm. As a result, the accuracy of the alignment of the nozzles 1 between the combined units 101*b*-1 and 101*b*-2 can be high, i.e., about ±5 μm. Note that, if the abutting portions 51, 52, 53 and 54 are formed by a dicing blade, the above-mentioned distance accuracy may be ±10 μm, and the above-mentioned alignment accuracy may be ±10 μm.

Thus, the deviation of droplets among black ink, yellow ink, cyan ink and magenta ink can be decreased, which could not degrade the printing quality.

In the above-described embodiment, one ink jet head is constructed by two combined units 101*b*-1 and 101*b*-2; however, one ink jet head can be constructed by three or more combined units. For example, if one unit is formed for one nozzle column, one ink jet head can be constructed by four combined units.

Also, in the above-described embodiment, the substrate 71 is made of monocrystalline silicon; however, the substrate 71 can be made of other crystal or metal. If the substrate 71 is made of metal, a mechanical pressing process or an electroforming process can be performed thereon, so that the nozzles 1 and the like can be formed.

Further, in the above-described embodiment, the nozzles 1 are arranged in a matrix in each of the nozzle columns 11 and 12; however, the arrangement of the nozzles 1 can be staggered in each of the nozzle columns 11 and 12.

As explained hereinabove, according to the present invention, since one ink jet head is constructed by a plurality of combined units, the manufacturing yield of each unit is increased, so that the manufacturing yield of the ink jet head can be increased, which would decrease the manufacturing cost.

What is claimed is:

1. An ink jet head having a plurality of self aligned combined units, wherein each of said units comprises:

a plurality of abutting portions; and at least one recessed portion shaped to engage at least one of said plurality of abutting portions formed on another unit to form said ink jet head having a plurality of self aligned combined units, wherein at least a first of said plurality of self aligned combined units includes a first protruded abutting portion and at least a second one of said plurality of self aligned combined units includes a second protruded abutting portion, said first and second protruded abutting portions abutting against each other.

2. The ink jet head as set forth in claim 1, wherein said units comprises:

a silicon substrate where nozzles, pressure chambers, ink passage and ink pools are formed;

a vibration plate fixed to said silicon substrate to partition said pressure chambers and said ink passages and said ink pools; and actuators, fixed to said vibration plate, each for vibrating a portion of said vibration plate corresponding to one of said nozzles.

3. The ink jet head as set forth in claim 2, wherein the nozzles are arranged in a matrix.

4. The ink jet head as set forth in claim 1, wherein the plurality of self aligned combined units are formed on a monocrystalline silicon substrate.

5. The ink jet head as set forth in claim 1, wherein each of said units further includes a plurality of nozzles arranged in a matrix.

6. The ink jet head as set forth in claim 5, wherein each of said plurality of nozzles are staggered with respect to each other.

7. The ink jet head of claim 1, wherein said first unit includes said recessed portion and a first relief formed between said recessed portion and said first protruded abutting portion and said second unit includes a second relief formed between two protruded abutting portions thereof.

8. The ink jet head of claim 1, wherein an area formed by said first protruded abutting portion of said first unit abutting said second protruded abutting portion of said second unit is filled with an adhesive.

9. An ink jet head having a plurality of combined units, wherein each of said units comprises:

a first protruded abutting portion;

a recessed abutting portion positioned at an opposite side of said first protruded abutting portion;

a second protruded abutting portion on the same side of said first protruded abutting portion; and a third protruded abutting portion positioned on an opposite side of said second protruded abutting portion, wherein said recessed abutting portion and said third protruded abutting portion of at least a first one of said plurality of combined units abuts against said first and said second protruded abutting portions, respectively, of at least a second one of said combined plurality of units.

10. The ink jet head of claim 9, wherein a first relief is formed in said first unit between said recessed abutting portion and said third protruded abutting portion and a second relief is formed in said second unit between said first and second protruded abutting portions.

11. The ink jet head of claim 9, wherein an area formed by said first protruded abutting portion of said first unit abutting said second protruded abutting portion of said second unit is filled with an adhesive.

12. A method for manufacturing an ink jet head, comprising the steps of:

forming a plurality of units in a substrate, each of said plurality of units including a plurality of abutting portions and a least one recessed portion;

separating said units from each other; and forming one ink jet by combining at least two of said units by coupling said at least one recessed portion and at least one of said plurality of abutting portions of one unit with at least two of said plurality of abutting portions of another unit, wherein said at least two of said units are self aligned by said plurality of abutting portions and said at least one recessed portion, wherein at least a first one of said plurality of units includes a first protruded abutting portion and at least a second one of said plurality of units includes a second protruded abutting portion, said first and second protruded abutting portions abutting against each other.

13. The method as set forth in claim 12, wherein said unit forming step comprises the steps of:

forming edge portions along a first direction and nozzles in said substrate, said edges dividing said units;

forming pressure chambers, ink passages and ink pools in said substrate;

adhering a vibration plate to said substrate to partition said pressure chambers, said ink passages and said ink pools; and adhering actuators to said vibration plate.

14. The method as set forth in claim 13, wherein said edge and nozzle forming step uses a photolithography and dry etching process.

15. The method as set forth in claim 13, wherein said pressure chamber, ink passage and ink pool forming step uses a photolithography and anisotropic etching process.

16. The method as set forth in claim 13, wherein said separating step comprises a step of cutting said substrate by a dicing blade along a second direction perpendicular to said first direction.

17. The method as set forth in claim 12, wherein said unit forming step comprises the steps of:

forming edge portions along a first direction and nozzles in said substrate, said edges dividing said units;

forming pressure chambers, ink passages and ink pools in said substrate;

preparing a vibration plate to which actuators are adhered in advance; and adhering said vibration plate to said substrate to partition said pressure chambers, said ink passages and said ink pools.

18. The method as set forth in claim 17, wherein said edge and nozzle forming step uses a photolithography and dry etching process.

19. The method as set forth in claim 17, wherein said pressure chamber, ink passage and ink pool forming step uses a photolithography and anisotropic etching process.

20. The method as set forth in claim 17, wherein said separating step comprises a step of cutting said substrate by a dicing blade along a second direction perpendicular to said first direction.

21. The method for manufacturing an ink jet head of claim 12, wherein said first unit includes a relief in a side including said first protruded abutting portion and said second unit includes a relief in a side including said second protruded abutting portion.

22. The method for manufacturing an inkjet head of claim 12, wherein an area formed by said first protruded abutting portion of said first unit abutting said second protruded abutting portion of said second unit is filled with an adhesive.

23. A method for manufacturing an ink jet head, comprising the steps of:

forming a plurality of units in a substrate;

separating said units from each other; and forming one ink jet head by combining at least two of said units, wherein each of said units comprises:

a first protruded abutting portion;

a recessed abutting portion positioned at an opposite side of said first protruded abutting portion;

a second protruded abutting portion on the same side of said first protruded abutting portion;

a third protruded abutting portion positioned on an opposite side of said second protruded abutting portion; and abutting the recessed abutting portion and the third protruded abutting portion of one of said units against the first and the second protruded abutting portions, respectively, of another of said units.

24. The method of manufacturing an ink jet head of claim 23, wherein said one of said units includes a first relief in a side including said first protruded abutting portion and said another of said units includes a second relief in a side including said third protruded abutting portion.

25. The method of manufacturing an ink jet head of claim 23, wherein an area formed by said second protruded abutting portion of said another unit abutting against said third protruded abutting portion of said one unit is filled with an adhesive.

26. An ink jet head having a plurality of self aligned combined units, comprising:

a first unit having a plurality of protruded abutting portions and at least one recessed abutting portion; and a second unit having a plurality of protruded abutting portions and at least one recessed abutting portion, wherein at least one of said abutting portions of said first unit is configured to be coupled to at least one of said plurality of protruded abutting portions of said second unit and said at least one recessed abutting portion of said first unit is configured to be coupled to another of said plurality of protruded abutting portions of said second unit.

27. The ink jet head of claim 26, wherein said first unit includes a first relief in a side including a first protruded abutting portion thereof and said second unit includes a second relief in a side including a second protruded abutting portion thereof.

28. The ink jet head of claim 26, wherein an area formed by said first protruded abutting portion of said first unit abutting against said second protruded abutting portion of said second unit is filled with an adhesive.

* * * * *